United States Patent [19]

Carr

[11] Patent Number: 4,997,186

[45] Date of Patent: Mar. 5, 1991

[54] RACKET FRAME HAVING MULTI-DIMENSIONAL CROSS-SECTIONAL CONSTRUCTION

[75] Inventor: Ronald H. Carr, Monroeville, Pa.

[73] Assignee: Ferrari Importing Company, Inc., Pittsburgh, Pa.

[21] Appl. No.: 449,198

[22] Filed: Dec. 8, 1989

[51] Int. Cl.[5] ..... A63B 49/02

[52] U.S. Cl. ..... 273/73 C; 273/73 G

[58] Field of Search ..... 273/67 R, 72 R, 72 C, 273/6

[56] References Cited

U.S. PATENT DOCUMENTS

| | | | |
|---|---|---|---|
| 2,164,631 | 7/1939 | Abell | 273/73 |
| 2,171,223 | 8/1939 | Robinson | 273/73 |
| 2,282,195 | 5/1942 | Compte | 273/73 |
| 2,481,075 | 9/1949 | Brown | 273/73 |
| 2,878,020 | 3/1959 | Robinson | 273/73 |
| 3,633,910 | 6/1972 | Spenle | 273/73 |
| 4,192,505 | 3/1980 | Tabickman et al. | 273/73 C |
| 4,280,699 | 7/1981 | Drake | 273/73 C |
| 4,293,129 | 10/1981 | Planakis | 273/67 R |
| 4,436,305 | 3/1984 | Fernandez | 273/73 C |
| 4,440,392 | 4/1984 | Popplewell | 273/73 C |
| 4,561,655 | 12/1985 | Mortvedt | 273/73 C |
| 4,664,380 | 5/1987 | Koebler | 273/73 C |
| 4,768,786 | 9/1988 | Koebler | 273/73 R |

*Primary Examiner*—Edward M. Coven

*Assistant Examiner*—Raleigh W. Chiu

*Attorney, Agent, or Firm*—Michael R. Swartz; John R. Flanagan

[57] ABSTRACT

A racket frame, such as for a tennis racket, has a head portion, a handle portion and a throat portion extending between and interconnecting the head and handle portions. The head portion encompasses an open region and has a plurality of stringing holes for attaching stringing to the head portion and across the open region. The throat portion is in the form of a pair of legs in a generally V-shaped configuration. Different cross-sectional dimensional relationships are incorporated in the racket frame to tailor racket frame stiffness. A first cross-sectional dimensional relationship relates to location of the maximum cross-sectional height of the racket frame in a lower extent of the head portion thereof so as to define a dual reverse tapered profile along the cross-sectional height of the racket frame. A second cross-sectional dimensional relationship relates to provision of an abrupt transition in an inwardly facing surfaces of the head portion of the racket frame so as to define a dual tapered profile along the cross-sectional width of the racket frame head portion. A third cross-sectional dimensional relationship relates to variation of cross-sectional height to width along the throat portion of the racket frame so as to define greater throat portion height nearer to the head portion and greater throat portion width nearer to the handle portion.

16 Claims, 3 Drawing Sheets

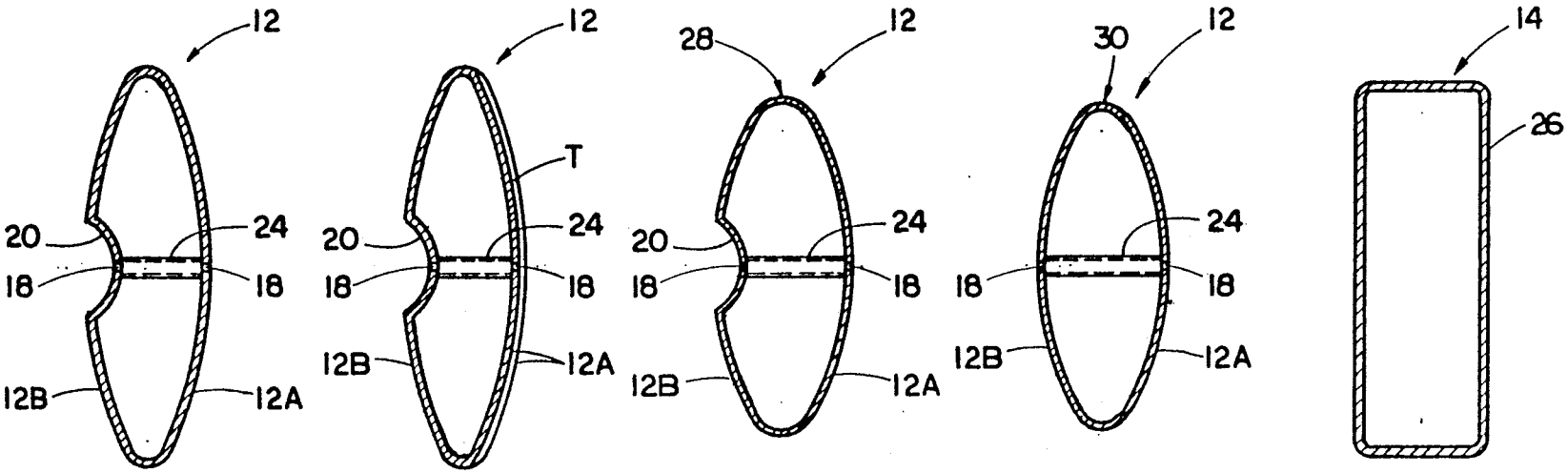
FIG. 3
FIG. 4
FIG. 5
FIG. 6
FIG. 7
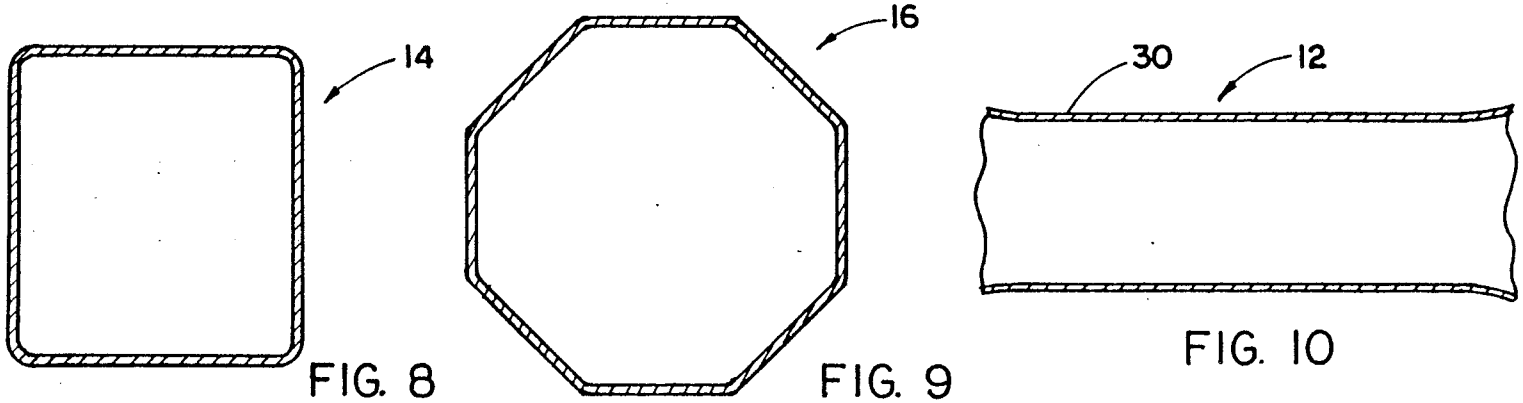
FIG. 8
FIG. 9
FIG. 10

RACKET FRAME HAVING MULTI-DIMENSIONAL CROSS-SECTIONAL CONSTRUCTION

CROSS REFERENCE TO RELATED APPLICATION

Reference is hereby made to the following copending application dealing with related subject matter and assigned to the assignee of the present invention:

"Racket Frame Having Holes For Tailoring Frame Stiffness" by Harry M. Ferrari et al, assigned U.S. Ser. No. 07/303,782 and filed Jan. 27, 1989.

BACKGROUND OF THE INVENTION

1. Field of the Invention

The present invention generally relates to rackets for use in games and, more particularly, is concerned with a racket frame having a multi-dimensional cross-sectional construction.

2. Description of the Prior Art

A conventional game racket frame, such as a tennis racket frame, is ordinarily an integral structure which includes a head portion, a throat portion and a handle portion. Typically, the racket frame is fabricated of composite-type material composed of high modulus fibers such as graphite fibers or glass fibers in a matrix of an epoxy resin. Also, racket frames have been fabricated from other materials, such as aluminum, wood and plastics.

The head portion of the racket frame typically has a round or oval configuration and contains a plurality of holes aligned in a common plane for applying stringing under tension and in a grid pattern across the head portion to provide a ball striking area of the racket. The throat portion of the racket frame is a principal structural element of the racket and provides structural connection between the head portion and the handle portion. The handle portion of the racket frame is usually covered with an outer sheath for facilitating gripping of the racket by the user's hand.

The construction of a conventional tennis racket poses several shortcomings to achievement of ball striking accuracy. In one common constructional feature, the cross-section of the racket frame is held constant along the length of the throat and head portion of the racket frame. In another common constructional feature, the cross sectional height of the frame, measured in a direction normal to the plane of the stringing, is varied along the length of the throat and head portion of the racket frame while maintaining the same width of the cross-section, measured in a direction parallel to the stringing, and the same basic geometric cross-section of the racket frame, be it oval, circular, or rectangular shape. These common features can result in either inaccuracies of ball striking directional aim, lower ball striking power or velocity, increased high frequency shock transmitted to the player's arm, reduced effective hitting area of the stringing, reduced maneuverability of the racket frame, or a combination of these deficiencies.

The prior art contains tennis racket constructions which implicitly or explicitly attempt to overcome struck ball directional inaccuracies. Representative of the prior art are the U.S. Patents to Abell (2,164,631), Robinson (2,171,223 and 2,878,020), Brown (2,481,075), Spenle (3,633,910), Tabickman et al (4,192,505), Fernandez (4,436,305), Popplell (4,440,392) and Kuebler (4,664,380 and 4,768,786). The approach of the Kuebler patents is to provide the maximum height (measured in a direction normal to the stringing plane) of the racket frame in a triangular or bight region of the throat portion of the frame where it intersects with the head portion and to taper the height both toward the handle portion and the head portion of the racket frame in opposite directions along the longitudinal axis of the racket.

However, there are practical limitations on how much the frame height can be increased which may restrict the utility of the approach of the Kuebler patents in overcoming one or more of the above-described deficiencies of a conventional racket frame. One limitation is that a significant increase in frame height in the head portion adjacent the throat portion of the frame to stiffen the head portion against deflection may interfere adversely with rebounding of the struck ball off the stringing and thus reduce the effective ball striking area of the racket stringing. Another limitation is that increasing the frame height has the disadvantage of increasing the amount of material in the racket frame and thus frame weight in a corresponding fashion which limits the maneuverability of the frame.

Consequently, in view of the above-described drawbacks of the approach of the prior art patents to overcoming the struck ball directional inaccuracies of conventional tennis racket frame construction, a need still exists for another approach which will overcome these deficiencies without creating new ones in their place.

SUMMARY OF THE INVENTION

The present invention provides a racket frame construction designed to satisfy the aforementioned deficiencies. In contrast to the approach of the Kuebler patent which is to tailor racket frame stiffness solely by increasing the frame height at certain regions of the frame, the approach of the present invention is to tailor racket frame stiffness by introduction of several different cross-sectional dimensional relationships in the racket frame. These different dimensional relationships vary the stiffness in the various portions of the racket frame to overcome the shortcomings of the conventional racket frame without the necessity to significantly increase the height of the frame. By appropriately establishing the different dimensional relationships, it is believed that bending and twisting of the racket frame can be reduced to insignificant levels. The benefits to the user of the racket frame construction of the present invention is enhanced racket feel and maneuverability, greater ball control and power, and improved player comfort through reduced shock transmission to the arm.

Accordingly, the present invention relates to different cross-sectional dimensional relationships incorporated in a racket frame. The racket frame includes a head portion encompassing an open region and having a plurality of stringing holes for attaching stringing to the head portion and across the open region, a handle portion, and a throat portion extending between and interconnecting the head and handle portions.

One cross-sectional dimensional relationship of the present invention relates to the location of the maximum cross-sectional height of the racket frame in typically a lower half of the head portion so as to define a dual reverse tapered profile along the cross-sectional height of the racket frame for providing improved racket power and control through greater frame stiffness in the direction normal to the plane of the racket stringing. The cross-sectional height of the racket frame, which is the dimension in the direction normal to the plane of the open region encompassed by the head portion, tapers from a maximum height at a lower half of the head portion in opposite directions to the base of the throat portion and to an upper tip region of an upper half of the head portion. Further the cross-sectional height of the racket frame is greater at the upper tip region of the head portion than at the lowermost portion of the racket frame.

Another cross-sectional dimensional relationship of the present invention relates to an abrupt transition in the inwardly facing surface of the head portion of the racket frame so as to define a dual tapered profile along the cross-sectional width of the racket frame head portion for providing greater torsional resistance and a more centered and expanded racket power zone through increased stiffness of the oval shaped hoop in the head of the racket frame. The cross-sectional width of the head portion of the racket frame, which is the dimension extending normal to the cross-sectional height thereof, is typically greater in the extent of the head portion running from the location of the maximum cross-sectional height of the racket frame to the upper tip region than in the extent of the head portion running from the location of the maximum cross-sectional height of the racket frame to the lower bight region thereof.

Another cross-sectional dimensional relationship of the present invention relates to the variation of cross-sectional height to width along the throat portion of the racket frame so as to further enhance racket stiffness and control. In particular, the throat portion decreases in cross-sectional height from the head portion to the base of the throat portion and increases in cross-sectional width from the head portion to the base of the throat portion. This cross-sectional dimensional relationship provides for a more flexible throat portion of the racket frame than would have been created if the cross-sectional width had been held constant which results in a lessened degree of harmful high frequency shock transmitted to the player's arm and greater feel and control of the ball upon impact with the racket stringing.

Another cross-sectional dimensional relationship of the present invention relates to the basic geometric shape of the cross-section of the racket frame in the throat portion and head portion of the racket frame so as to enhance racket stiffness without the need to increase the cross-sectional height of the racket frame which can limit the maneuverability of the racket frame and effective hitting area of the racket stringing. The geometric cross-section of the throat portion of the racket frame is a general four-sided rectangular shape to provide increased racket frame stiffness in a direction normal to the plane of the racket stringing without the need to excessively increase the cross-sectional height of the racket frame whereas the cross-section of the head portion of the racket frame is a general aerodynamic oval shape so as to reduce the amount of material in the cross-section in the head portion of the racket frame for reduced overall frame weight, balance, and improved maneuverability. The benefits to be gained by the various improvements embodied in the present invention can be achieved by utilizing these improvements either individually or in their various possible combinations.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which:

FIG. 3 is an enlarged cross-sectional view of a maximum height lower region of the head portion of the tennis racket frame taken along line 3—3 of FIG. 1.

FIG. 4 is another enlarged cross-sectional view of the lower region of the head portion of the tennis racket frame taken along line 4—4 of FIG. 1.

FIG. 5 is an enlarged cross-sectional view of an upper tip region of the head portion of the tennis racket frame taken line 5—5 of FIG. 1.

FIG. 6 is an enlarged cross-sectional view of a lower bight region of the head portion of the tennis racket frame taken along 6—6 of FIG. 1.

FIG. 7 is an enlarged cross-sectional view of one leg region of the throat portion of the tennis racket frame taken along 7—7 of FIG. 1.

FIG. 8 is an enlarged cross-sectional view of the intersection at the lower end of the throat portion of the tennis racket frame taken along line 8—8 of FIG. 1.

FIG. 9 is an enlarged cross-section view of the handle portion of the tennis racket frame taken along line 9—9 of FIG. 1.

FIG. 10 is an enlarged cross-sectional view of the bight region of the head portion of the tennis racket frame taken along line 10—10 of FIG. 1.

DETAILED DESCRIPTION OF THE INVENTION

Figure 2:
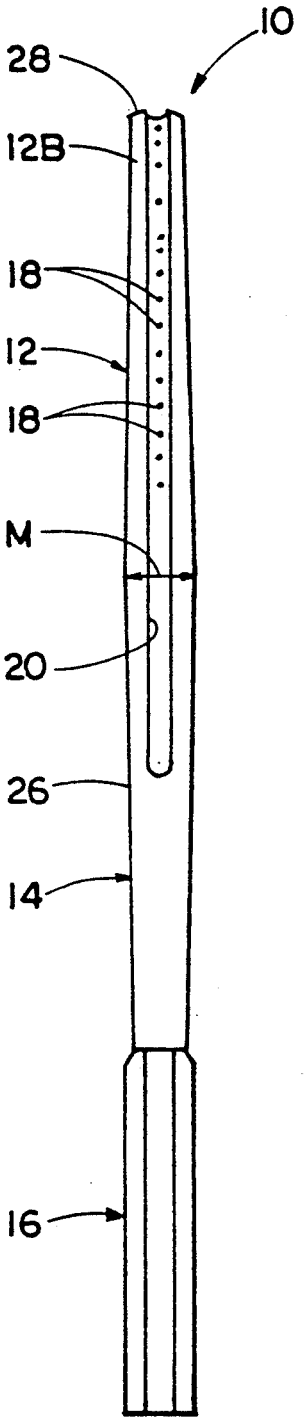
FIG. 2 is a side elevational view of the tennis racket frame as seen along line 2—2 of FIG. 1.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

In General

Figure 1:
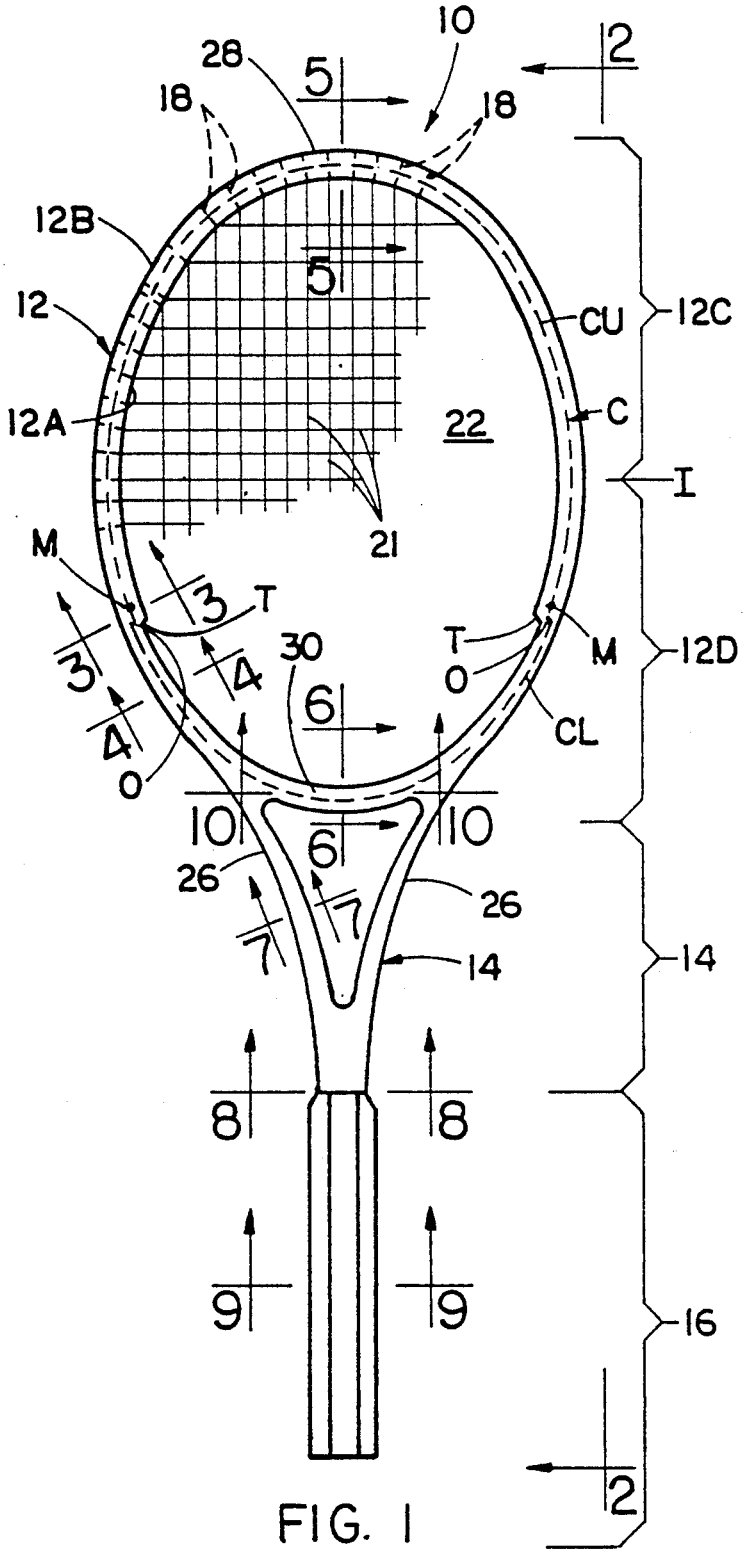
FIG. 1 is a plan view of a tennis racket frame in accordance with the present invention.
Figure 12:
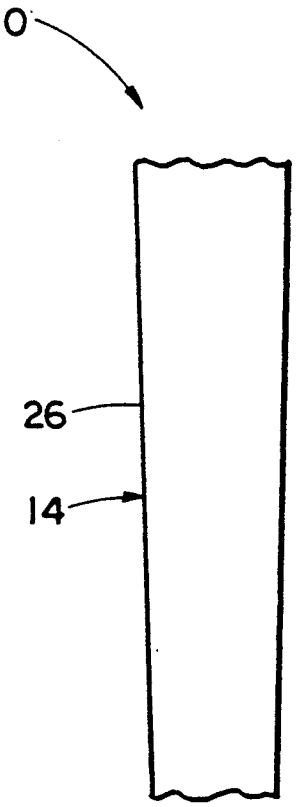
FIG. 12 is a side elevational view of the tennis racket frame as seen along line 12—12 of FIG. 11.
Figure 11:
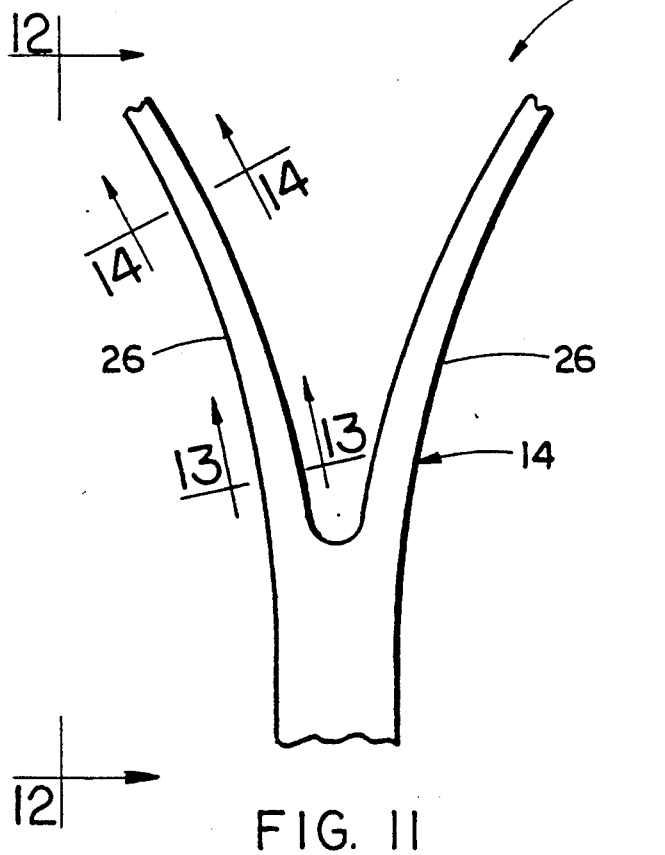
FIG. 11 is an enlarged plan view of the throat portion of the tennis racket frame of FIG. 1.
Figure 13:
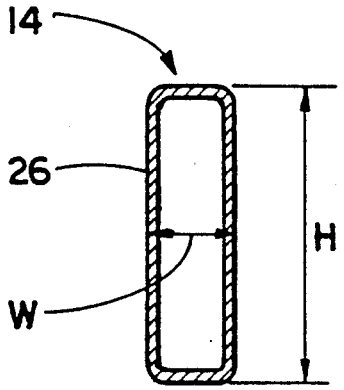
FIG. 13 is an enlarged cross-sectional view of one leg region of the throat portion of the tennis racket frame taken along line 13—13 of FIG. 11.
Figure 14:
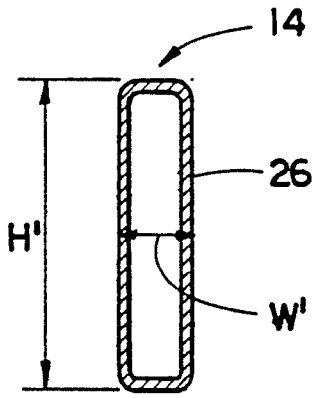
FIG. 14 is another enlarged cross-sectional view of the one leg region of the throat portion of the tennis racket frame taken along line 14—14 of FIG. 11.

Referring now to the drawings, and particularly to FIGS. 1–2, there is shown a tennis racket frame, generally indicated by the numeral 10 and constructed in accordance with the principles of the present invention. While the constructional principles of the present invention are illustrated and described in conjunction with a tennis racket frame, they are believed to be equally applicable to the racket frames used in playing other sports comparable to tennis, such as squash and badminton. Therefore, the reference hereafter to a tennis racket frame should be construed in a generic sense as applicable to other sport racket frames.

In its basic construction, the tennis racket frame 10 is a one-piece structure which includes a head portion 12, a throat portion 14 and a handle portion 16. The racket frame 10 is typically fabricated of composite-type material composed of high modulus fibers such as graphite fibers or glass fibers in a matrix of an epoxy resin. Alternatively, the racket frame 10 can be fabricated from other materials, such as aluminum, wood and plastics.

The head portion 12 of the racket frame 10 typically has a round or oval configuration and the frame typically has a hollow or solid construction. The head portion 12 contains aligned pluralities of stringing holes 18 defined respectively along an inwardly facing surface 12A and along a narrow recess 20 formed in an outwardly facing surface 12B of the head portion 12. The pluralities of stringing holes 18 are aligned in a common plane. In a conventional manner, stringing 21 can be applied under tension through the holes 18 and across the open region 22 encompassed by the head portion 12 to form a grid pattern across the head portion, providing a ball striking area of the racket. The recess 20 is provided to protect the outer exposed portions of the stringing 21 located at the stringing holes 18. Typically, the head portion 12 has grommets 24 (FIGS. 3–6) mounted within its interior so as to extend between aligned ones of the holes 18 and through which the stringing 21 is threaded.

The handle portion 16 of the racket frame 10 includes an outer sheath (not shown) for facilitating gripping of the racket by the user's hand. The throat portion 14 interconnecting the head and handle portions 12, 16 typically is in the form of a pair of shafts or legs 26 in a generally V-shaped configuration.

Racket Frame Multi-Dimensional Cross-Sectional Construction

As mentioned earlier, the approach of the present invention is to tailor racket frame stiffness by introduction of several different cross-sectional dimensional relationships in the racket frame. These different dimensional relationships vary the stiffness of the frame to overcome the shortcomings of the conventional racket frame.

Referring again to FIGS. 1 and 2, the first cross-sectional dimensional relationship of the present invention pertains to the location of the maximum cross-sectional height M of the racket frame 10. The head portion 12 of the racket frame 10 has an upper half 12C located remote from the throat portion 14 and a lower half 12D located adjacent to and connected with the throat portion 14. The cross-sectional height of the racket frame 10 refers to its dimension in the direction (as represented by the double arrow at maximum height M in FIG. 2) normal to the plane of the open region 22 encompassed by the head portion 12. As best seen in FIG. 2, the cross-sectional height tapers from a maximum height at M in the lower half 12D of the head portion 12 in opposite directions to the base of the throat portion 14 and to an upper tip region 28 of the upper half 12C of the head portion 12. With such construction, it can be readily observed that a dual reverse tapered profile is provided along the cross-sectional height of the racket frame 10 originating from the location of maximum cross-sectional height M in the lower half 12D of the head portion 12.

More particularly, the maximum cross-sectional height M of the racket frame 10 at the lower half 12D of the head portion 12 is located between about one-quarter to one-half of the axial distance from an intersection I of the upper and lower halves 12C, 12D of the head portion 12 to a lower bight region 30 thereof. Preferably, the maximum cross-sectional height M of the racket frame 10 is located along the lower half 12D of the head portion 12 about two-thirds of the longitudinal distance from the upper tip region 28 to the lower bight region 30 of the head portion 12. Further, as can be readily observed in FIGS. 2, 5 and 8, the cross-sectional height of the racket frame 10 is greater at the upper tip region 28 of the head portion 12 than at the lower end of the throat portion 14 of the racket frame 10.

Referring to FIGS. 1, 3 and 4, the second cross-sectional dimensional relationship of the present invention pertains to the formation of matching abrupt transitions or steps T in the inwardly facing surface 12A of the head portion 12 of the racket frame 10. The cross-sectional width of the head portion 12 of the racket frame 10, which is the dimension extending normal to the cross-sectional height thereof and generally parallel to the plane of the open region 22, is greater in the upper extent of the head portion 12 running from the approximate location of the maximum cross-sectional height M of the racket frame 10 to the upper tip region 28 than in the lower extent of the head portion 12 running from the approximate location of the maximum cross-sectional height M of the racket frame 10 to the lower bight region 30 thereof. With such construction, it can be readily observed that a dual tapered profile is provided along the cross-sectional width of the racket frame 10 originating from the approximate location of maximum cross-sectional height M in the lower half 12D of the head portion 12 and extending in opposite directions therefrom. However, it should be understood that it is within the purview of the present invention to provide the location of the transition T spaced somewhat above or below the location of the maximum cross-sectional height M of the racket frame 10.

More particularly, in the plan view of FIG. 1, it can be observed that the head portion 12 is in the shape of an oval loop. The upper extent of the head portion 12 having the greater cross-sectional width encompasses about 240° of the loop, whereas the lower extent of the head portion 12 having the lesser cross-sectional width encompasses about 120° of the loop. Further, the head portion 12 has a generally oval geometric cross-sectional configuration throughout its extent even though the heights and widths of the oval configuration varies at different locations therealong, as can be observed in FIGS. 3–6. Also, the opposite inwardly and outwardly facing surfaces 12A and 12B of the head portion 12 define therebetween a dashed centerline C shown in FIG. 1 in the shape of a 360° loop. Due to the location of the transitions or steps T formed in the inwardly facing surface 12A (which divides the surface 12A into upper and lower portions that are coextensive with the upper and lower extents of the head portion 12), the portion CU of the centerline C running through the upper extent of the head portion 12 terminates at ends which are inwardly offset at 0 from adjacent ends at which terminates the portion CL of the centerline C running through the lower extent of the head portion 12. Similarly, the upper extent of the head portion 12 encompasses about 240° of the loop defined by the centerline C and the lower extent of the head portion 12 encompasses about 120° of the centerline loop.

Referring to FIGS. 1, 7, 8 and 11–14, the third cross-sectional dimensional relationship of the present invention pertains to the variation of cross-sectional height to width along the throat portion 14 of the racket frame 10. As best seen in FIGS. 11–14, the throat portion 14 decreases in cross-sectional height ($H<H'$) from the head portion 12 to the handle portion 16 and increases in cross-sectional width ($W>W'$) from the head portion 12 to the handle portion 16. Since, the throat portion 14 is composed by the pair of legs 26 in a V-shaped configuration, each leg 26 decreases in cross-sectional height from the head portion 12 to the handle portion 16 and increases in cross-sectional width from the head portion 12 to the handle portion 16.

Referring to FIGS. 1 and 3–8, the fourth cross-sectional dimensional relationship of the present invention pertains to the basic geometric configuration of the cross-sections in the head portion 12 and throat portion 14 of the racket frame 10. As best seen in FIGS. 3–6, the geometric cross-section of the head portion 12 of the racket frame 10 represents a basic oval shape configuration, whereas the geometric cross-section of the throat portion 12 of the racket frame 10, as best seen in FIGS. 7 and 8, represent a basic rectangular shaped configuration.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A racket frame, comprising:

a head portion encompassing an open region and having a plurality of stringing holes for attaching stringing to said head portion and across said open region;

a handle portion; and a throat portion extending between and interconnecting said head and handle portions;

said head portion having approximately an upper half located remote from said throat portion and a lower half located adjacent to said throat portion;

said racket frame having a cross-sectional height, being the dimension in a direction normal to the plane of said open region encompassed by said head portion, which tapers from a maximum height within said head portion in opposite directions to said throat portion and to an upper tip region of said upper half of said head portion.

2. The racket frame as recited in claim 1, wherein said cross-sectional height of said racket frame is greater at said upper tip region of said upper half of said head portion than at said lower region of said throat portion at the transition between said throat and handle portions.

3. The racket frame as recited in claim 1, wherein the maximum cross-sectional height of said racket frame is located between about one-quarter to one-half of the axial distance from an intersection of said upper and lower halves of said head portion to a lower bight region thereof.

4. The racket frame as recited in claim 1, wherein the maximum cross-sectional height of said racket frame is located along said lower half of said head portion about two-thirds of the axial distance from said upper tip region to a lower bight region of said head portion.

5. The racket frame as recited in claim 1, wherein said throat portion decreases in cross-sectional height from said head portion to said handle portion and increases in cross-sectional width, which extends normal to the cross-sectional height, from said head portion to said handle portion.

6. The racket frame as recited in claim 1, wherein the cross-sectional width of said head portion, being the dimension extending normal to the cross-sectional height thereof, is greater in the upper extent of said head portion than in the lower extent of said head portion adjacent to said throat portion.

7. The racket frame as recited in claim 6, wherein said head portion is in the shape of a 360° loop, the upper extent of said head portion having the greater cross-sectional width encompassing about 240° of said loop and the lower extent of said head portion having the lesser cross-sectional width encompassing about 120° of said loop.

8. The racket frame as recited in claim 1 wherein said head portion has a continuous inwardly facing surface containing an upper surface portion running between the location of the maximum cross-sectional height and said upper tip region, a lower surface portion running between the location of the maximum cross-sectional height and said lower bight region, and a pair of transition surface portions interconnecting adjacent ends of said upper and lower surface portions at the location of the maximum cross-sectional height of said racket frame.

9. A racket frame, comprising:

(a) a head portion encompassing an open region and having a plurality of stringing holes for attaching stringing to said head portion and across said open region;

(b) a handle portion; and (c) a throat portion extending between and interconnecting said head and handle portions;

(d) said head portion having an oval cross-sectional configuration with opposite inwardly and outwardly facing surfaces which define therebetween a centerline in the shape of a 360° loop and having transitions in said inwardly facing surface which divide said head portion into upper and lower extents thereof such that a portion of said centerline running through said upper extent of said head portion terminates at ends which are offset from adjacent ends at which terminates the portion of the centerline running through said lower extent of said head portion, said outwardly facing surface of said head portion being smooth and continuous with no offset transitions and said inwardly facing surface of each of said upper and lower extents of said head portion being smooth and continuous with no offset transitions except for said offset transitions defined by the terminated ends of said centerlines of said upper and lower extents.

10. The racket frame as recited in claim 9, wherein said upper extent of said head portion encompasses about 240° of said loop defined by said centerline and said lower extent of said head portion encompasses about 120° of said loop defined by said centerline.

11. A racket frame, comprising:

a head portion encompassing an open region and having a plurality of stringing holes for attaching stringing to said head portion and across said open region;

a handle portion; and a throat portion extending between and interconnecting said head and handle portions, said throat portion decreasing in cross-sectional height from said head portion to said handle portion and increasing in cross-sectional width, which extends normal to the cross-sectional height, from said head portion to said handle portion;

said head portion having an oval cross-sectional configuration with opposite inwardly and outwardly facing surfaces which define therebetween a centerline in the shape of a 360° loop and having transitions in said inwardly facing surface which divide said head portion into upper and lower extents thereof such that a portion of said centerline running through said upper extent of said head portion terminates at ends which are offset from adjacent ends at which terminates the portion of the centerline running through said lower extent of said head portion.

12. A racket frame, comprising:

a head portion encompassing an open region and having a plurality of stringing holes for attaching stringing to said head portion and across said open region;

a handle portion; and a throat portion extending between and interconnecting said head and handle portions, said throat portion decreasing in cross-sectional height from said head portion to said handle portion and increasing in cross-sectional width, which extends normal to the cross-sectional height, from said head portion to said handle portion;

said head portion having approximately an upper half located remote from said throat portion and a lower half located adjacent to said throat portion;

said head portion being in the shape of a 360° loop and having a cross-sectional width, being the dimension in a direction parallel to the plane of said open region encompassed by said head portion, which is greater in an upper extent of said head portion and lesser in a lower extent of said head portion.

13. A racket frame, comprising:

a head portion encompassing an open region and having a plurality of stringing holes for attaching stringing to said head portion and across said open region;

a handle portion; and a throat portion extending between and interconnecting said head and handle portions, said throat portion decreasing in cross-sectional height from said head portion to said handle portion and increasing in cross-sectional width, which extends normal to the cross-sectional height, from said head portion to said handle portion;

said head portion having approximately an upper half located remote from said throat portion and a lower half located adjacent to said throat portion;

said head portion having a cross-sectional width, being the dimension in a direction parallel to the plane of said open region encompassed by said head portion, which is greater in said upper half of said head portion and also in said lower half of said head portion above a location therein disposed at about one-quarter to one-half of the axial distance from an intersection of said upper and lower halves of said head portion to a lower bight region thereof.

14. The racket frame as recited in claim 13, wherein said location is disposed along said lower half of said head portion about two-thirds of the axial distance from said upper tip region to said lower bight region of said head portion.

15. A racket frame, comprising:

(a) a head portion encompassing an open region and having a plurality of stringing holes for attaching stringing to said head portion and across said open region;

(b) a handle portion; and (c) a throat portion extending between and interconnecting said head and handle portions, said throat portion decreasing in cross-sectional height, being the dimension which extends normal to said open region of said head portion, from said head portion to said handle portion and increasing in cross-sectional width, which extends normal to the cross-sectional height, from said head portion to said handle portion.

16. A racket frame comprising:

(a) A head portion encompassing an open region and having a plurality of stringing holes for attaching stringing to said head portion and across said open region, said head portion having a cross-sectioned configuration of a generally aerodynamic oval shape so as to reduce the amount of material in said head portion for reduced overall frame weight, balance and improved maneuverability;

(b) a handle portion; and a throat portion extending between said head and handle portions and having a generally four-sided rectangular configuration to provide increased racket frame stiffness in a direction normal to the plane of the racket stringing without the need to excessively increase the cross-sectional height of the racket.

* * * * *